US012721450B2

(12) United States Patent
Cao

(10) Patent No.: US 12,721,450 B2
(45) Date of Patent: Sep. 1, 2026

(54) AIR MATTRESS

(71) Applicant: Ningbo Snowwolf Outdoor Products Technology Co., Ltd., Ningbo (CN)

(72) Inventor: Yun Cao, Ningbo (CN)

(73) Assignee: Ningbo Snowwoif Outdoor Products Technology Co., Ltd., Ningbo (CN)

( * ) Notice: Subject to any disclaimer, the term of this patent is extended or adjusted under 35 U.S.C. 154(b) by 330 days.

(21) Appl. No.: 18/389,871

(22) Filed: Dec. 20, 2023

(65) Prior Publication Data

US 2025/0151923 A1 May 15, 2025

(30) Foreign Application Priority Data

Nov. 14, 2023 (CN) ..... 202311514716.9

(51) Int. Cl.
*A47C 27/10* (2006.01)

(52) U.S. Cl.
CPC ..... *A47C 27/10* (2013.01)

(58) Field of Classification Search
CPC ..... A47C 27/08; A47C 27/081; A47C 27/082; A47C 27/10
USPC ..... 5/710
See application file for complete search history.

(56) References Cited

U.S. PATENT DOCUMENTS 2,360,715 A * 10/1944 Hough ..... B60N 2/7052 5/709
4,541,135 A * 9/1985 Karpov ..... A47C 27/087 5/710
6,240,584 B1 * 6/2001 Perez ..... A47C 27/082 5/713
6,611,981 B1 * 9/2003 Lin ..... A47C 27/081 5/413 AM
6,763,540 B1 * 7/2004 Wang ..... A47C 27/10 5/713
8,413,277 B2 * 4/2013 Davis ..... F16K 15/202 137/512.1
8,656,539 B1 * 2/2014 Boyd ..... A47C 27/087 5/713
2006/0021133 A1 * 2/2006 Davis ..... A61G 7/1028 5/81.1 R (Continued)

FOREIGN PATENT DOCUMENTS

CN 201088329 Y 7/2008
CN 201097864 Y 8/2008

(Continued)

*Primary Examiner* — David E Sosnowski
(74) *Attorney, Agent, or Firm* — Bayramoglu Law Offices LLC

(57) ABSTRACT

An air mattress, comprising: a mattress body, where the mattress body comprises at least a bed surface, a first air chamber and a second air chamber are formed inside the mattress body, the first air chamber and the second air chamber are isolated from each other, the first air chamber is located below the bed surface, the second air chamber is located on an outer side of the bed surface, and the second air chamber surrounds the bed surface; and an air charging/discharging valve, where there are at least two air charging/discharging valves, and the two air charging/discharging valves respectively communicate with the first air chamber and the second air chamber. In the present invention, a support requirement for the air mattress can be satisfied during softness adjustment of the air mattress.

14 Claims, 4 Drawing Sheets

(56) References Cited

U.S. PATENT DOCUMENTS

| | | | | |
|---|---|---|---|---|
| 2008/0289114 | A1* | 11/2008 | Viard | F16K 31/1266 5/710 |
| 2016/0242562 | A1* | 8/2016 | Karschnik | A47C 27/082 |
| 2018/0328504 | A1* | 11/2018 | Huang | F16K 15/202 |
| 2020/0400149 | A1* | 12/2020 | Huang | F04D 29/601 |
| 2020/0400150 | A1* | 12/2020 | Huang | F04D 25/06 |
| 2021/0381611 | A1* | 12/2021 | Gaines | F16K 15/031 |
| 2022/0202198 | A1* | 6/2022 | Li | A47C 27/087 |
| 2023/0218091 | A1* | 7/2023 | Shi | F16K 31/53 5/710 |
| 2023/0309701 | A1* | 10/2023 | Shi | A47C 27/10 5/119 |
| 2024/0016303 | A1* | 1/2024 | Shi | A47C 27/082 |
| 2024/0016304 | A1* | 1/2024 | Li | A47C 27/087 |
| 2025/0049225 | A1* | 2/2025 | Tao | A47C 27/087 |

FOREIGN PATENT DOCUMENTS

| | | | | | |
|---|---|---|---|---|---|
| CN | 110680114 | A | | 1/2020 | |
| CN | 213308611 | U | * | 6/2021 | A47C 27/087 |
| CN | 113662389 | A | * | 11/2021 | A47C 27/082 |
| CN | 216494492 | U | * | 5/2022 | A47C 27/087 |
| CN | 116831411 | A | * | 10/2023 | A47C 27/082 |

* cited by examiner

AIR MATTRESS

CROSS REFERENCE TO RELATED APPLICATIONS

This application is based upon and claims foreign priority to Chinese Patent Application No. CN202311514716.9, filed on Nov. 14, 2023, the entire contents of which are incorporated herein by reference.

TECHNICAL FIELD

The present invention relates to the field of outdoor product technologies, and in particular, to an air mattress.

BACKGROUND

An air mattress is a mattress that expands in volume after being inflated. The air mattress features strong flexibility and good elasticity. The air mattress is easy to carry after deflation, and is convenient to use, and therefore is widely used in various fields. Particularly, advantages of the air mattress are more prominent in outdoor products. Different users have different elasticity requirements for the mattress. Existing air mattresses are generally low in air pressure, insufficient in support force, uneven in bed surface, uneven in support, insufficient in stability, prone to tip, inconvenient in inflation and deflation, subjected to slow air leakage, etc. In addition, in the conventional technology, elasticity of the air mattress is usually adjusted through inflation and deflation. To be specific, when the elasticity is relatively large, the air mattress is deflated to be softer. When flexibility of the air mattress is adjusted in this manner, the mattress is particularly prone to collapse downward after deflation. In addition, because the air mattress is relatively light, when air in the mattress is insufficient, the air mattress is prone to tip when a user sits on an edge of the mattress, that is, flexibility and support requirements for the air mattress cannot be satisfied during actual use.

SUMMARY

The present invention provides an air mattress, which can ensure a support requirement for the air mattress during softness adjustment of the air mattress.

To resolve the foregoing technical problem, the present invention provides an air mattress, including:

a mattress body, where the mattress body includes at least a bed surface, a first air chamber and a second air chamber are formed inside the mattress body, the first air chamber and the second air chamber are isolated from each other, the first air chamber is located below the bed surface, the second air chamber is located on an outer side of the bed surface, and the second air chamber surrounds the bed surface; and an air charging/discharging valve, where there are at least two air charging/discharging valves, and the two air charging/discharging valves respectively communicate with the first air chamber and the second air chamber.

According to the foregoing technical solution, preferably, the mattress body further includes a bed bottom, the bed bottom is located below the first air chamber, a third air chamber is further formed inside the mattress body, the third air chamber communicates with the first air chamber, and the third air chamber is located on an outer side of the bed bottom and surrounds the bed bottom.

According to the foregoing technical solution, preferably, the mattress body further includes a side fender, the side fender is located on outer sides of the bed surface and the bed bottom, the side fender includes a side fender film layer and a side fender cloth layer, the side fender film layer is located on an inner side of the side fender cloth layer, and an upper end and a lower end of the side fender respectively form a sealed connection to the bed surface and the bed bottom.

According to the foregoing technical solution, preferably, the mattress body further includes a first separation film layer, an upper end and a lower end of the first separation film layer respectively form a sealed connection to an inner side surface of the side fender, the upper end of the first separation film layer is close to the bed surface, the lower end of the first separation film layer is away from the bed surface, the second air chamber is formed between an outer side surface of the first separation film layer and the inner side surface of the side fender, and the first air chamber is formed on an inner side of the first separation film layer.

According to the foregoing technical solution, preferably, the first separation film layer is connected to the side fender film layer through hot melt, and the upper end of the first separation film layer is located between an upper surface of the bed surface and the side fender.

According to the foregoing technical solution, preferably, the mattress body further includes a second separation film layer, an upper end and a lower end of the second separation film layer respectively form a sealed connection to an inner side surface of the side fender, the lower end of the second separation film layer is close to the bed bottom, the upper end of the second separation film layer is away from the bed bottom, the third air chamber is formed between an outer side surface of the second separation film layer and the inner side surface of the side fender, the second air chamber is on an inner side of the second separation film layer, and the second separation film layer is provided with a connection hole, so that the third air chamber communicates with the first air chamber.

According to the foregoing technical solution, preferably, the second separation film layer is connected to the side fender film layer through hot melt, and the lower end of the second separation film layer is located between a lower surface of the bed bottom and the side fender.

According to the foregoing technical solution, preferably, a fender reinforcement cloth is laminated on an outer side of the side fender.

According to the foregoing technical solution, preferably, the bed surface includes a bed-surface base cloth and a bed-surface lamination film, the bed-surface lamination film is laminated on an upper surface of the bed-surface base cloth, the bed-surface lamination film and the side fender film layer are hot-melted to form a sealed connection, the bed bottom includes a bed-bottom base cloth and a bed-bottom lamination film, the bed-bottom lamination film is laminated on a lower surface of the bed-bottom base cloth, the bed-bottom lamination film and the side fender film layer are hot-melted to form a sealed connection, and wires are disposed between the bed-surface base cloth and the bed-bottom base cloth.

According to the foregoing technical solution, preferably, the air charging/discharging valve includes an air charging/discharging valve base, an air charging/discharging channel is formed on the air charging/discharging valve base, a flat annular protrusion is formed on an outer surface of the air charging/discharging valve base, the air charging/discharging valve bases of the two air charging/discharging valves respectively extend into the first air chamber and the second air chamber, the air charging/discharging valve base is further provided with a lateral air charging/discharging hole, the lateral air charging/discharging hole communicates with the air charging/discharging channel, a side surface of the annular protrusion formed on the air charging/discharging valve base and the side fender film layer are hot-melted to form a sealed connection, a filter is mounted on the air charging/discharging valve base through a cable tie, and the filter covers an open end of the air charging/discharging channel.

According to the foregoing technical solution, preferably, a distribution density of the wires is greater than 10000 wires per square meter, and the bed-surface lamination film, the bed-bottom lamination film, and the side fender film layer are made of TPU materials. Fabrics with a wire design are used, and a structure with more than 10000 wires per square meter ensures that the bed surface is flat and has even support. There is less friction between the wires, so that noise is reduced and stability is good, and the air mattress is easily inflated or deflated without air leakage.

The air mattress provided in the present invention includes the mattress body and two air charging/discharging valves. A top of the mattress body is the bed surface for sleep, and the mattress body has at least two mutually separated air chambers: the first air chamber and the second air chamber. The two air charging/discharging valves respectively inflate and deflate the first air chamber and the second air chamber. The first air chamber is located below the bed surface, and can adjust softness and comfort of the bed surface through inflation and deflation of the first air chamber. The second air chamber is disposed on an outer side of the bed surface, and the second air chamber can be inflated through the air charging/discharging valve to ensure support of the entire structure, to prevent support of the air mattress from becoming weak because the air mattress is in a soft state, and especially prevent a user from slipping off from the bed surface because the bed surface is prone to be deformed during load bearing after the bed surface becomes soft.

The foregoing descriptions are merely an overview of the technical solutions of the present invention. To understand the technical means of the present invention more clearly, the technical means may be implemented according to the content of this specification. In addition, to make the foregoing and other objectives, features, and advantages of the present invention clearer and easier to understand, the following describes specific implementations of the present invention.

In the figures: 100. mattress body; 200. air charging/discharging valve; 10. bed surface; 20. bed bottom; 30. wire; 40. first air chamber; 50. second air chamber; 60. side fender; 70. first separation film layer; 80. fender reinforcement cloth; 90. third air chamber; 110. connection hole; 120. second separation film layer; 601. side fender cloth layer; 602. side fender film layer; 101. bed-surface base cloth; 102. bed-surface lamination film; 201. bed-bottom base cloth; 202. bed-bottom lamination film; 2001. air charging/discharging valve base; 2002. annular protrusion; 2003. air charging/discharging channel; 2004: lateral air charging/discharging hole; 2005. filter; and 2006. cable tie.

DETAILED DESCRIPTION OF THE EMBODIMENTS

To make the objectives, features, and advantages of the present invention clearer and easier to understand, the following clearly and comprehensively describes the technical solutions in the embodiments of the present invention with reference to the accompanying drawings in the embodiments of the present invention. Clearly, the described embodiments are merely some rather than all of the embodiments of the present invention. Based on the embodiments of the present invention, all other embodiments obtained by a person skilled in the art without creative efforts fall within the protection scope of the present invention.

Figure 1:
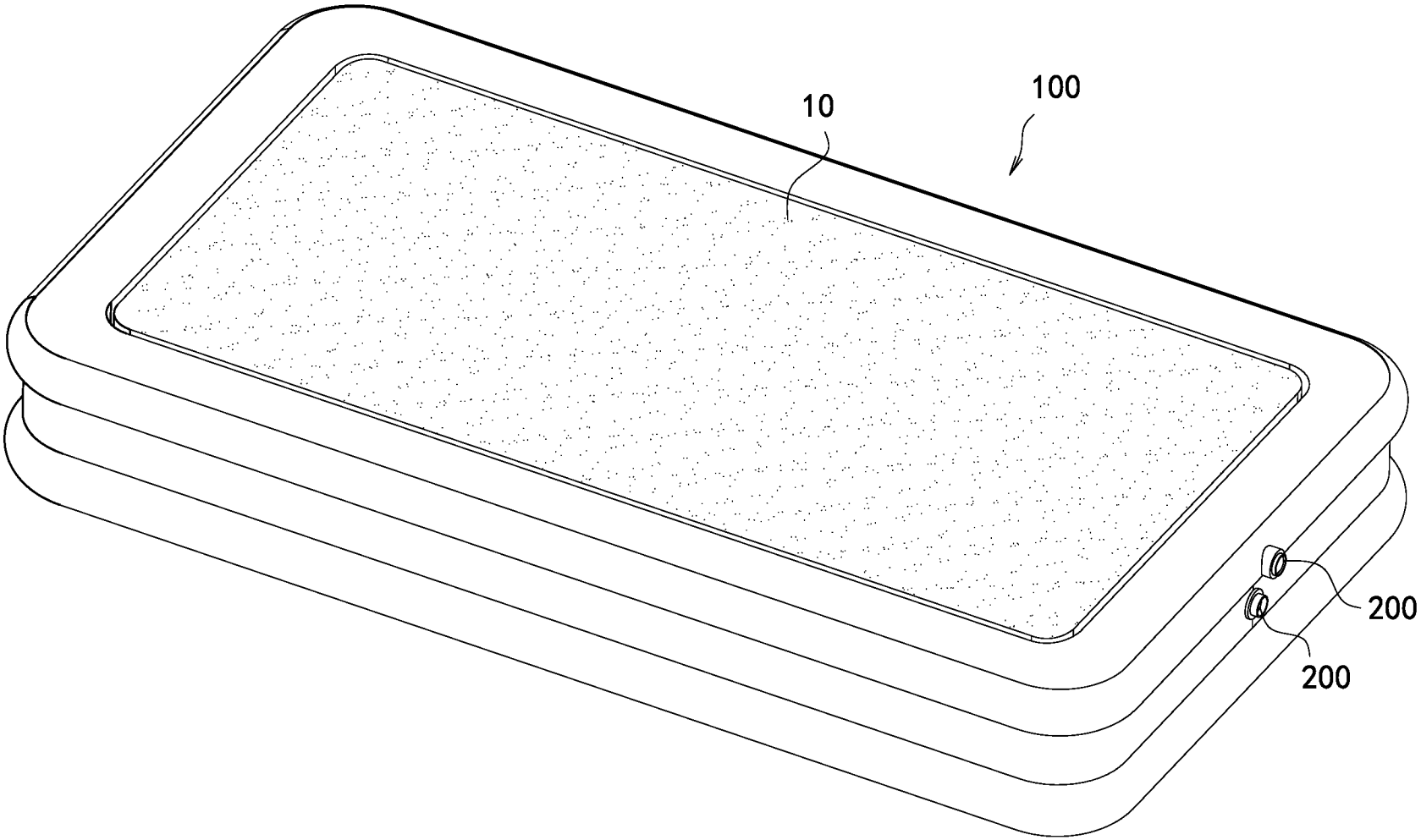
FIG. 1 is a schematic diagram of an appearance structure of an air mattress according to an embodiment of the present invention.
Figure 2:
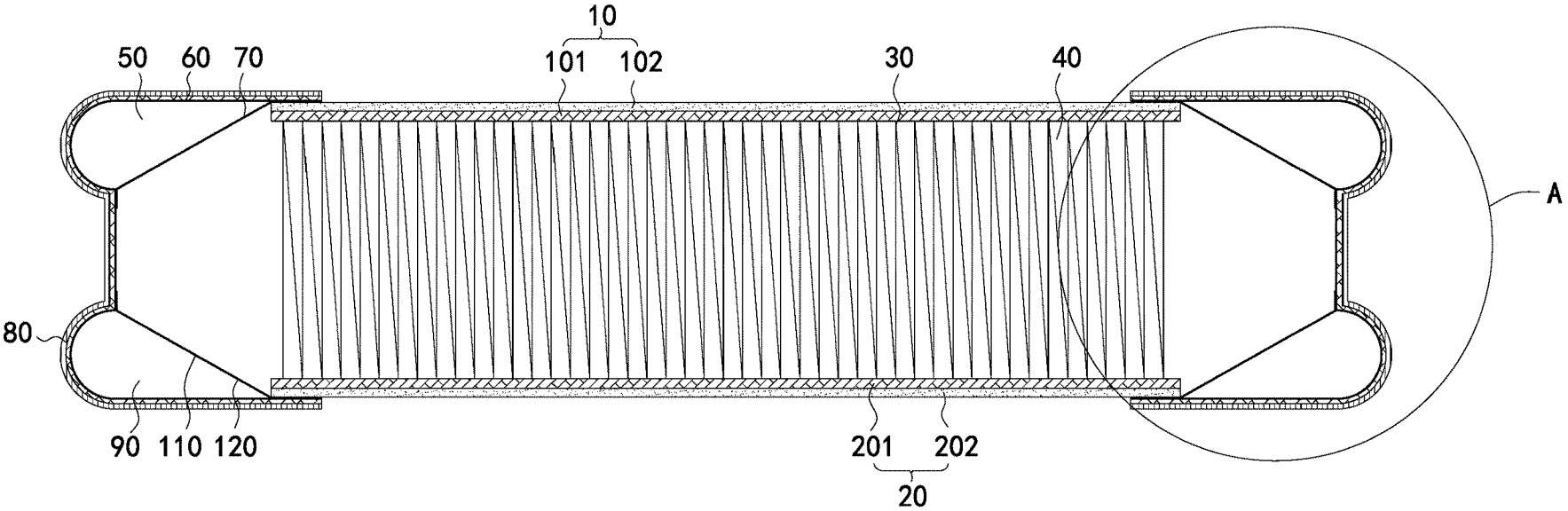
FIG. 2 is a sectional view of an air mattress according to an embodiment of the present invention.
Figure 3:
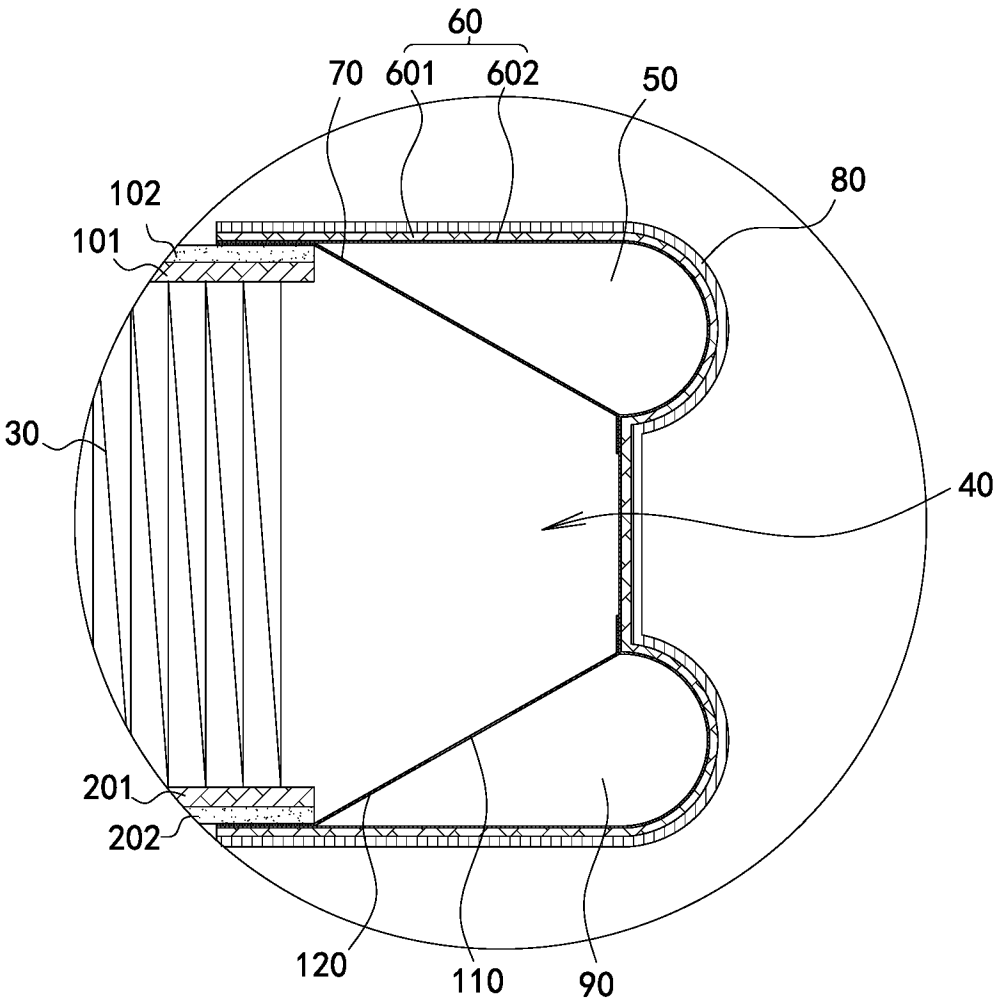
FIG. 3 is a schematic diagram obtained after A in FIG. 2 is enlarged.
Figure 4:
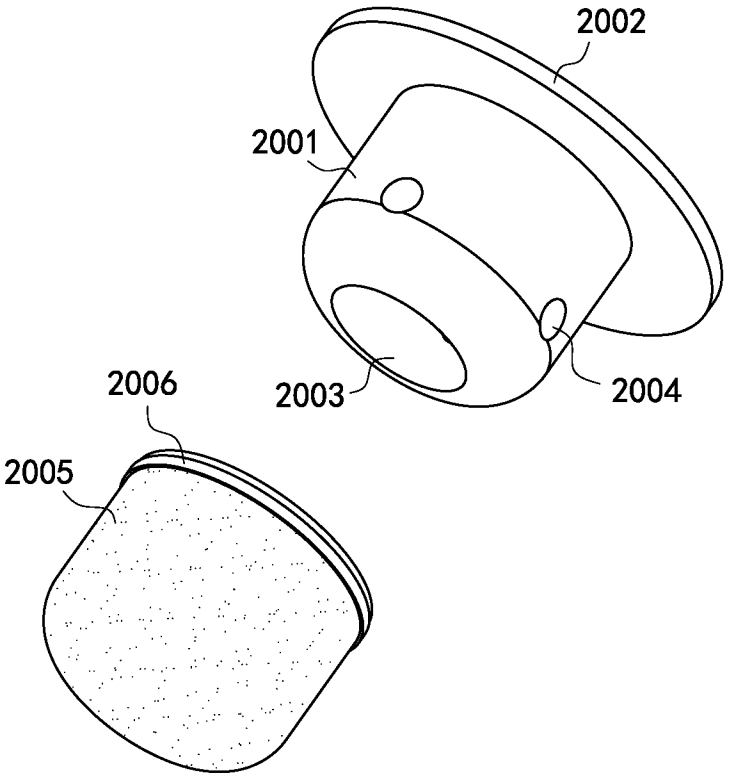
FIG. 4 is a schematic diagram of a three-dimensional structure of an air charging/discharging valve according to an embodiment of the present invention.

Referring to FIG. 1 to FIG. 4, an embodiment of the present invention provides an air mattress, including:

- a mattress body 100, where the mattress body 100 includes at least a bed surface 10, a first air chamber 40 and a second air chamber 50 are formed inside the mattress body 100, the first air chamber 40 and the second air chamber 50 are isolated from each other, the first air chamber 40 is located below the bed surface 10, the second air chamber 50 is located on an outer side of the bed surface 10, and the second air chamber 50 surrounds the bed surface 10; and
- an air charging/discharging valve 200, where there are at least two air charging/discharging valves 200, and the two air charging/discharging valves 200 respectively communicate with the first air chamber 40 and the second air chamber 50.

The air mattress provided in this embodiment includes the mattress body 100 and two air charging/discharging valves 200. A top of the mattress body 100 is the bed surface 10 for sleep, and the mattress body 100 has at least two mutually separated air chambers: the first air chamber 40 and the second air chamber 50. The two air charging/discharging valves 200 respectively inflate and deflate the first air chamber 40 and the second air chamber 50. The first air chamber 40 is located below the bed surface 10 and can adjust softness and comfort of the bed surface 10 through inflation and deflation of the first air chamber 40. The second air chamber 50 is disposed on the outer side of the bed surface 10, and the second air chamber 50 can be inflated through the air charging/discharging valve 200 to ensure support of the entire structure, to prevent support of the air mattress from becoming weak because the air mattress is in a soft state, and especially prevent a user from slipping off from the bed surface 10 because the bed surface 10 is prone to be deformed during load bearing after the bed surface 10 becomes soft.

In a further feasible manner of this embodiment, the mattress body 100 further includes a bed bottom 20, the bed bottom 20 is located below the first air chamber 40, a third air chamber 90 is further formed inside the mattress body 100, the third air chamber 90 communicates with the first air chamber 40, and the third air chamber 90 is located on an outer side of the bed bottom 20 and surrounds the bed bottom 20.

During actual use, if air pressure of the mattress body 100 is relatively large and overall support is relatively high, when a user sits on one side, the air mattress is prone to tip or warp. In this embodiment, the third air chamber 90 can improve a contact area, and softness of the third air chamber 90 is consistent with softness of the bed surface 10, so that the air mattress is not prone to tip when overall support of the mattress body 100 is good.

In a further feasible manner of this embodiment, the mattress body 100 further includes a side fender 60, the side fender 60 is located on outer sides of the bed surface 10 and the bed bottom 20, the side fender 60 includes a side fender film layer 602 and a side fender cloth layer 601, the side fender film layer 602 is located on an inner side of the side fender cloth layer 601, and an upper end and a lower end of the side fender 60 respectively form a sealed connection to the bed surface 10 and the bed bottom 20.

In this embodiment, the side fender 60 is better sealed after being connected to the bed surface 10 and the bed bottom 20, and a process can be simplified to reduce costs. In addition, the side fender 60 can bear larger pressure, so that an overall structure is stronger.

In a further feasible manner of this embodiment, the mattress body 100 further includes a first separation film layer 70, an upper end and a lower end of the first separation film layer 70 respectively form a sealed connection to an inner side surface of the side fender 60, the upper end of the first separation film layer 70 is close to the bed surface 10, the lower end of the first separation film layer 70 is away from the bed surface 10, the second air chamber 50 is formed between an outer side surface of the first separation film layer 70 and the inner side surface of the side fender 60, and the first air chamber 40 is formed on an inner side of the first separation film layer 70.

In this embodiment, the first separation film layer 70 can be used to separate the first air chamber 40 and the second air chamber 50. In addition, the first separation film layer 70 is made of thin film materials and uses a hot melt process, so that an overall structure and a process can be simplified to reduce costs. Moreover, the first separation film layer 70 is disposed on the side fender 60, which can further improve a high-pressure resistance capability of the side fender 60. Finally, pressure between the first air chamber 40 and the second air chamber 50 can be further adjusted by using the first separation film layer 70. Specifically, when the first air chamber 40 is deflated, the first separation film layer 70 is elastically deformed toward the first air chamber 40, and when the first air chamber 40 is inflated, the second air chamber 50 is extruded.

In a further feasible manner of this embodiment, the first separation film layer 70 is connected to the side fender film layer 602 through hot melt, and the upper end of the first separation film layer 70 is located between an upper surface of the bed surface 10 and the side fender 60.

In this embodiment, the upper end of the first separation film layer 70 is located between the upper surface of the bed surface 10 and the side fender 60, thereby improving overall connection strength.

In a further feasible manner of this embodiment, the mattress body 100 further includes a second separation film layer 120, an upper end and a lower end of the second separation film layer 120 respectively form a sealed connection to an inner side surface of the side fender 60, the lower end of the second separation film layer 120 is close to the bed bottom 20, the upper end of the second separation film layer 120 is away from the bed bottom 20, the third air chamber 90 is formed between an outer side surface of the second separation film layer 120 and the inner side surface of the side fender 60, the second air chamber 50 is on an inner side of the second separation film layer 120, and the second separation film layer 120 is provided with a connection hole 110, so that the third air chamber 90 communicates with the first air chamber 40.

In this embodiment, the third air chamber 90 communicates with the first air chamber 40 through the connection hole 110 on the second separation film layer 120, which can greatly simplify a generation process. In addition, the second separation film layer 120 is disposed on the side fender 60, so that a pressure resistance capability of the side fender 60 can be improved.

In a further feasible manner of this embodiment, the second separation film layer 120 is connected to the side fender film layer 602 through hot melt, and the lower end of the second separation film layer 120 is located between a lower surface of the bed bottom 20 and the side fender 60.

In a further feasible manner of this embodiment, a fender reinforcement cloth 80 is laminated on an outer side of the side fender 60.

In this embodiment, the fender reinforcement cloth 80 can improve a high-pressure resistance capability of the side fender 60, to prevent the side fender 60 from bulging outward when the side fender 60 is subjected to high pressure.

In a further feasible manner of this embodiment, the bed surface 10 includes a bed-surface base cloth 101 and a bed-surface lamination film 102, the bed-surface lamination film 102 is laminated on an upper surface of the bed-surface base cloth 101, the bed-surface lamination film 102 and the side fender film layer 602 are hot-melted to form a sealed connection, the bed bottom 20 includes a bed-bottom base cloth 201 and a bed-bottom lamination film 202, the bed-bottom lamination film 202 is laminated on a lower surface of the bed-bottom base cloth 201, the bed-bottom lamination film 202 and the side fender film layer 602 are hot-melted to form a sealed connection, and wires 30 are disposed between the bed-surface base cloth 101 and the bed-bottom base cloth 201.

In this embodiment, the structures of the bed surface 10 and the bed bottom 20 are more conducive to forming a sealed connection to the side fender 60. In addition, the wires 30 are disposed between the bed-surface base cloth 101 and the bed-bottom base cloth 201, so that hardness is better in an inflated state and support for a human body is also better, and when the human body is lying on the bed surface, the bed surface is not deformed to become uneven. Moreover, with the existence of the structure of the third air chamber 90, in combination with the wire structure, it can be ensured that the bed surface 10 and the bed bottom 20 have better support for the human body, and it can be further ensured that the mattress body 100 does not tip or warp.

In a further feasible manner of this embodiment, the air charging/discharging valve 200 includes an air charging/discharging valve base 2001, an air charging/discharging channel 2003 is formed on the air charging/discharging valve base 2001, a flat annular protrusion 2002 is formed on an outer surface of the air charging/discharging valve base 2001, the air charging/discharging valve bases 2001 of the two air charging/discharging valves 200 respectively extend into the first air chamber 40 and the second air chamber 50, the air charging/discharging valve base 2001 is further provided with a lateral air charging/discharging hole 2004, the lateral air charging/discharging hole 2004 communicates with the air charging/discharging channel 2003, a side surface of the annular protrusion 2002 formed on the air charging/discharging valve base 2001 and the side fender film layer 602 are hot-melted to form a sealed connection, a filter 2005 is mounted on the air charging/discharging valve base 2001 through a cable tie 2006, and the filter 2005 covers an open end of the air charging/discharging channel 2003.

In this embodiment, the side surface of the annular protrusion 2002 and the side fender film layer 602 are hot-melted to form a sealed connection, to improve sealing performance and prevent air leakage. In addition, the filter 2005 can prevent the wires 30 from being drawn out during deflation.

In the descriptions of this specification, descriptions provided with reference to terms such as "an embodiment", "some embodiments", "an example", "a specific example", or "some examples" intend to mean that specific features, structures, materials, or characteristics described with reference to the embodiment or the example are included in at least one embodiment or example of the present invention. In addition, the described specific features, structures, materials, or characteristics can be properly combined in any one or more of the embodiments or examples. In addition, a person skilled in the art can integrate and combine different embodiments or examples and features in different embodiments or examples described in this specification, provided that the embodiments or the examples and the features do not conflict with each other.

In addition, terms "first" and "second" are used only for description purposes, and should not be understood as an indication or an implication of relative importance or an implicit indication of a quantity of indicated technical features. Therefore, features defined with "first" or "second" may explicitly or implicitly include at least one of the features. In the descriptions of the present invention, "a plurality of" means two or more, unless otherwise specifically limited.

The foregoing descriptions are merely specific implementations of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. An air mattress, comprising:

a mattress body, wherein the mattress body comprises at least a bed surface, a first air chamber and a second air chamber are formed inside the mattress body, the first air chamber and the second air chamber are isolated from each other, the first air chamber is located below the bed surface, the second air chamber is located on an outer side of the bed surface, and the second air chamber surrounds the bed surface; and at least two air charging/discharging valves, and the at least two air charging/discharging valves respectively communicate with the first air chamber and the second air chamber, wherein the mattress body further comprises a bed bottom, the bed bottom is located below the first air chamber, a third air chamber is further formed inside the mattress body, the third air chamber communicates with the first air chamber, and the third air chamber is located on an outer side of the bed bottom and surrounds the bed bottom, wherein the mattress body further comprises a side fender, the side fender is located on outer sides of the bed surface and the bed bottom, the side fender comprises a side fender film layer and a side fender cloth layer, the side fender film layer is located on an inner side of the side fender cloth layer, and an upper end and a lower end of the side fender respectively form a sealed connection to the bed surface and the bed bottom, wherein the mattress body further comprises a second separation film layer, an upper end and a lower end of the second separation film layer respectively form a sealed connection to an inner side surface of the side fender, the third air chamber is formed between an outer side surface of the second separation film layer and the inner side surface of the side fender, the second air chamber is on an inner side of the second separation film layer, and the second separation film layer is provided with a connection hole, so that the third air chamber communicates with the first air chamber.

2. The air mattress according to claim 1, wherein the mattress body further comprises a first separation film layer, an upper end and a lower end of the first separation film layer respectively form a sealed connection to an inner side surface of the side fender, the second air chamber is formed between an outer side surface of the first separation film layer and the inner side surface of the side fender, and the first air chamber is formed on an inner side of the first separation film layer.

3. The air mattress according to claim 2, wherein the first separation film layer is connected to the side fender film layer through hot melt, and the upper end of the first separation film layer is located between an upper surface of the bed surface and the side fender.

4. The air mattress according to claim 3, wherein a fender reinforcement cloth is laminated on an outer side of the side fender.

5. The air mattress according to claim 3, wherein the bed surface comprises a bed-surface base cloth and a bed-surface lamination film, the bed-surface lamination film is laminated on an upper surface of the bed-surface base cloth, the bed-surface lamination film and the side fender film layer are hot-melted to form a sealed connection, the bed bottom comprises a bed-bottom base cloth and a bed-bottom lamination film, the bed-bottom lamination film is laminated on a lower surface of the bed-bottom base cloth, the bed-bottom lamination film and the side fender film layer are hot-melted to form a sealed connection, and wires are disposed between the bed-surface base cloth and the bed-bottom base cloth.

6. The air mattress according to claim 2, wherein a fender reinforcement cloth is laminated on an outer side of the side fender.

7. The air mattress according to claim 2, wherein the bed surface comprises a bed-surface base cloth and a bed-surface lamination film, the bed-surface lamination film is laminated on an upper surface of the bed-surface base cloth, the bed-surface lamination film and the side fender film layer are hot-melted to form a sealed connection, the bed bottom comprises a bed-bottom base cloth and a bed-bottom lamination film, the bed-bottom lamination film is laminated on a lower surface of the bed-bottom base cloth, the bed-bottom lamination film and the side fender film layer are hot-melted to form a sealed connection, and wires are disposed between the bed-surface base cloth and the bed-bottom base cloth.

8. The air mattress according to claim 2, wherein each of the at least two air charging/discharging valves comprises an air charging/discharging valve base, an air charging/discharging channel is formed on the air charging/discharging valve base, a flat annular protrusion is formed on an outer surface of the air charging/discharging valve base, two of the air charging/discharging valve bases of the at least two air charging/discharging valves respectively extend into the first air chamber and the second air chamber, each of the air charging/discharging valve bases is further provided with a lateral air charging/discharging hole, the lateral air charging/discharging hole communicates with the air charging/discharging channel, a side surface of the annular protrusion formed on each of the air charging/discharging valve bases and the side fender film layer are hot-melted to form a sealed connection, a filter is mounted on each of the air charging/discharging valve bases through a cable tie, and the filter covers an open end of the air charging/discharging channel.

9. The air mattress according to claim 1, wherein the second separation film layer is connected to the side fender film layer through hot melt, and the lower end of the second separation film layer is located between a lower surface of the bed bottom and the side fender.

10. The air mattress according to claim 9, wherein a fender reinforcement cloth is laminated on an outer side of the side fender.

11. The air mattress according to claim 9, wherein the bed surface comprises a bed-surface base cloth and a bed-surface lamination film, the bed-surface lamination film is laminated on an upper surface of the bed-surface base cloth, the bed-surface lamination film and the side fender film layer are hot-melted to form a sealed connection, the bed bottom comprises a bed-bottom base cloth and a bed-bottom lamination film, the bed-bottom lamination film is laminated on a lower surface of the bed-bottom base cloth, the bed-bottom lamination film and the side fender film layer are hot-melted to form a sealed connection, and wires are disposed between the bed-surface base cloth and the bed-bottom base cloth.

12. The air mattress according to claim 1, wherein a fender reinforcement cloth is laminated on an outer side of a side fender.

13. The air mattress according to claim 1, wherein the bed surface comprises a bed-surface base cloth and a bed-surface lamination film, the bed-surface lamination film is laminated on an upper surface of the bed-surface base cloth, the bed-surface lamination film and the side fender film layer are hot-melted to form a sealed connection, the bed bottom comprises a bed-bottom base cloth and a bed-bottom lamination film, the bed-bottom lamination film is laminated on a lower surface of the bed-bottom base cloth, the bed-bottom lamination film and the side fender film layer are hot-melted to form a sealed connection, and wires are disposed between the bed-surface base cloth and the bed-bottom base cloth.

14. The air mattress according to claim 1, wherein each of the at least two air charging/discharging valves comprises an air charging/discharging valve base, an air charging/discharging channel is formed on the air charging/discharging valve base, a flat annular protrusion is formed on an outer surface of the air charging/discharging valve base, two of the air charging/discharging valve bases of the at least two air charging/discharging valves respectively extend into the first air chamber and the second air chamber, each of the air charging/discharging valve bases is further provided with a lateral air charging/discharging hole, the lateral air charging/discharging hole communicates with the air charging/discharging channel, a side surface of the annular protrusion formed on each of the air charging/discharging valve bases and the side fender film layer are hot-melted to form a sealed connection, a filter is mounted on each of the air charging/discharging valve bases through a cable tie, and the filter covers an open end of the air charging/discharging channel.

* * * * *